US007591316B2

(12) United States Patent
Hatton

(10) Patent No.: US 7,591,316 B2
(45) Date of Patent: Sep. 22, 2009

(54) PRODUCTION SYSTEM

(75) Inventor: Stephen Hatton, Woking (GB)

(73) Assignee: 2H Offshore Engineering Ltd., Woking (GB)

( * ) Notice: Subject to any disclaimer, the term of this patent is extended or adjusted under 35 U.S.C. 154(b) by 140 days.

(21) Appl. No.: 11/515,964

(22) Filed: Sep. 5, 2006

(65) Prior Publication Data

US 2007/0056742 A1 Mar. 15, 2007

(30) Foreign Application Priority Data

Sep. 9, 2005 (GB) ..... 0518430.4

(51) Int. Cl.
*E21B 7/12* (2006.01)
*E21B 29/12* (2006.01)

(52) U.S. Cl. ..... 166/355; 166/350; 166/367; 405/224.2; 405/224.4

(58) Field of Classification Search ..... 166/367, 166/345, 350–352; 405/224.2, 224.3, 224.4; 114/230.12, 293
See application file for complete search history.

(56) References Cited

U.S. PATENT DOCUMENTS 3,601,075 A * 8/1971 Deslierres ..... 114/293
4,182,584 A * 1/1980 Panicker et al. ..... 405/224.3
4,400,109 A * 8/1983 Gentry et al. ..... 405/224.3
4,423,984 A * 1/1984 Panicker et al. ..... 405/224.3
4,459,066 A * 7/1984 van der Graaf ..... 405/224.3
4,478,586 A * 10/1984 Gentry et al. ..... 441/4
4,762,180 A * 8/1988 Wybro et al. ..... 166/350
4,793,737 A * 12/1988 Shotbolt ..... 405/169
4,878,694 A * 11/1989 Castel ..... 285/24
4,913,238 A * 4/1990 Danazcko et al. ..... 405/223.1
5,275,510 A * 1/1994 de Baan et al. ..... 405/171
5,480,264 A * 1/1996 Hunter ..... 405/195.1
5,505,560 A * 4/1996 Brown et al. ..... 405/195.1
5,615,977 A * 4/1997 Moses et al. ..... 405/195.1
5,639,187 A 6/1997 Mungall et al.
5,957,074 A 9/1999 de Baan et al.
6,062,769 A 5/2000 Cunningham
6,082,391 A * 7/2000 Thiebaud et al. ..... 137/236.1
6,109,833 A 8/2000 Savy
6,161,620 A * 12/2000 Cox et al. ..... 166/367
6,176,646 B1 * 1/2001 Finn et al. ..... 405/224.2
6,206,614 B1 * 3/2001 Blevins et al. ..... 405/224
6,206,742 B1 * 3/2001 Bull et al. ..... 441/1
6,213,215 B1 * 4/2001 Breivik et al. ..... 166/350
6,276,456 B1 * 8/2001 Head ..... 166/359
6,321,844 B1 * 11/2001 Thiebaud et al. ..... 166/345

(Continued)

FOREIGN PATENT DOCUMENTS

EP 0 277 840 8/1988

(Continued)

*Primary Examiner*—Thomas A Beach
(74) *Attorney, Agent, or Firm*—Burr & Brown

(57) ABSTRACT

A known deepwater solution for production risers for extracting oil and gas is the SLOR™ riser. The design of the SLOR™ riser is not compatible with large numbers of risers and thus there is a need for a deep water riser that can be deployed in large numbers, for example 20 to 30 risers. The present invention discloses a support frame that can be used to receive a plurality of risers, which can then be connected to a surface vessel.

13 Claims, 4 Drawing Sheets

U.S. PATENT DOCUMENTS

| | | | | |
|---|---|---|---|---|
| 6,375,391 | B1 * | 4/2002 | B.o slashed.rseth et al. | 405/224.4 |
| 6,402,431 | B1 * | 6/2002 | Nish | 405/224.3 |
| 6,415,828 | B1 * | 7/2002 | Duggal et al. | 141/387 |
| 6,558,215 | B1 * | 5/2003 | Boatman | 441/5 |
| 6,612,370 | B1 * | 9/2003 | Jahnsen et al. | 166/367 |
| 6,688,348 | B2 * | 2/2004 | Fontenot | 141/387 |
| 6,712,560 | B1 * | 3/2004 | Cottrell | 405/224.4 |
| 6,811,355 | B2 * | 11/2004 | Poldervaart | 405/169 |
| 7,040,841 | B2 * | 5/2006 | Kelm et al. | 405/224.2 |
| 7,063,158 | B2 * | 6/2006 | Horton, III | 166/355 |
| 7,073,593 | B2 * | 7/2006 | Hatton et al. | 166/367 |
| 2004/0126192 | A1 * | 7/2004 | Nish et al. | 405/224.2 |
| 2004/0129425 | A1 | 7/2004 | Wilson | |
| 2004/0156684 | A1 * | 8/2004 | Pionetti | 405/224.2 |
| 2005/0158126 | A1 | 7/2005 | Luppi | |

FOREIGN PATENT DOCUMENTS

| | | | |
|---|---|---|---|
| ES | 2 217 835 | | 9/2001 |
| GB | 2 191 230 | | 12/1987 |
| GB | 2 295 408 | | 5/1996 |
| GB | 2 322 834 | | 9/1998 |
| GB | 2 346 188 | | 8/2000 |
| GB | 2429993 | * | 3/2007 |
| WO | 97/22780 | | 6/1997 |
| WO | WO 9725242 A1 | * | 7/1997 |
| WO | 02/076818 | | 10/2002 |

* cited by examiner

PRODUCTION SYSTEM

This application claims the benefit of United Kingdom Application 0518430.4, filed Sep. 9, 2005, the entirety of which is incorporated herein by reference.

BACKGROUND a. Field of the Invention

The present invention relates to risers for use in the extraction of hydrocarbons and in particular to risers that are used to extract oil or gas from offshore and deepwater fields.

b. Related Art

Risers are high pressure dynamic tubular structures used in the extraction of oil and gas from offshore fields. They extend from the seabed to the surface production vessel and are used to transport oil, gas and injection fluids.

In deep water (for example a depth of greater than 1000 meters) there is often a limited number of feasible riser solutions for a particular field development. This is due to the many design, operational, commercial and contractual constraints. This limitation is particularly evident on developments in ultra deep water (a depth of typically between 1500 and 3000 meters) which typically require a large number of risers, utilise dynamic production vessels such as turret and spread moored Floating Production, Storage and Offloading (FPSO) vessels and are often located in an environment that has significant wave, current and wind loading. For these applications there is a demand for improved riser technology and system configurations to assist future developments.

FIG. 1 shows a schematic depiction of a Single Line Offset Riser (SLOR™), which is recognised as a field proven deepwater riser arrangement that has been successfully deployed on two West African projects. The SLOR comprises a near-vertical steel pipe section 2 which is tensioned by a near-surface buoyancy module 3. The connection to the production vessel 1 is made via a compliant, flexible pipe catenary section 4. At the seabed the vertical tension is reacted by a foundation (not shown) that can be either a driven pile, suction pile or gravity base structure.

It is anticipated that the SLOR arrangement will be used on future worldwide deepwater developments. However, the potential for structural clashing between adjacent SLORs requires a large separation to be maintained. FIG. 1 shows schematically that although the vessel 1 may be capable of receiving a significant number of risers it is necessary to provide a separation between the two SLORs shown in FIG. 1. In addition, clearance must be maintained with mooring lines and thus the scope of application of the SLORs is greatly limited to developments in which only a small number of risers is required. This can be a serious limitation on large deepwater projects where 20-30 risers is a typical requirement.

It is known to use near surface buoys to support a plurality of catenary risers, which connect to a respective plurality of flexible catenaries that provide a connection to a surface vessel. Examples of such arrangements can be found in, for example, U.S. Pat. No. 5,957,074 & U.S. Pat. No. 5,639,187.

SUMMARY OF THE INVENTION

According to a first aspect of the present invention there is provided a production system comprising: a plurality of vertical risers; a plurality of production catenaries; a plurality of buoyancy modules, each of the plurality of buoyancy modules being connected to the upper end of a respective one of the plurality of vertical risers; a support frame comprising a plurality of guide means for receiving each of the plurality of vertical risers, each of the plurality of risers being received within a respective guide means; each of the plurality of vertical risers being connected to a respective lower end of one of the plurality of production catenaries at the support frame; and the upper ends of each of the plurality of production catenaries being connected to a surface vessel.

Thus the buoyancy of each vertical riser is provided by the buoyancy module attached to the relevant vertical riser. This is an approach that is not followed in known techniques, such as those described in U.S. Pat. No. 5,957,074 & U.S. Pat. No. 5,639,187, wherein a single buoy provides the buoyancy for all of the catenary risers that are connected to the buoy. In this approach, any movement of the buoy will cause all of the supported catenary risers to move. In the present invention the frame supports and guides the vertical risers to prevent them from clashing or interfering with each other. As each of the vertical risers has its own respective buoyancy module, each of the risers is able to move independently of the frame and the other risers, for example due to thermal expansion or internal pressure. These differences provide significant commercial advantages when it comes to the installation and operation of a plurality of risers.

According to a second aspect of the present invention there is provided a method of connecting a vertical production riser to a surface vessel, the method comprising the steps of: a) connecting the vertical production riser to a buoyancy means at the upper end of the vertical production riser, b) supporting the vertical production riser and the buoyancy means within a support frame; c) connecting the production riser to a production catenary at the support frame; and d) connecting the production catenary to a surface vessel.

According to a third aspect of the present invention there is provided a method of connecting a plurality of production risers to a surface vessel, the method comprising the steps of: a) positioning a support framework in a position near to a plurality of vertical risers; b) attaching a respective buoyancy module to each of the plurality of vertical risers; c) lifting each of the plurality of vertical risers; d) connecting each of the plurality of vertical risers to the support framework such that the upper end of each of the plurality of vertical risers is secured to the support framework; e) connecting a respective production catenary to each of the plurality of vertical risers at the support framework; and f) connecting each of the plurality of production catenaries to the surface vessel.

BRIEF DESCRIPTION OF THE DRAWINGS

The invention will now be described, by way of example only, with reference to the following Figures in which.

DETAILED DESCRIPTION

Figure 2:
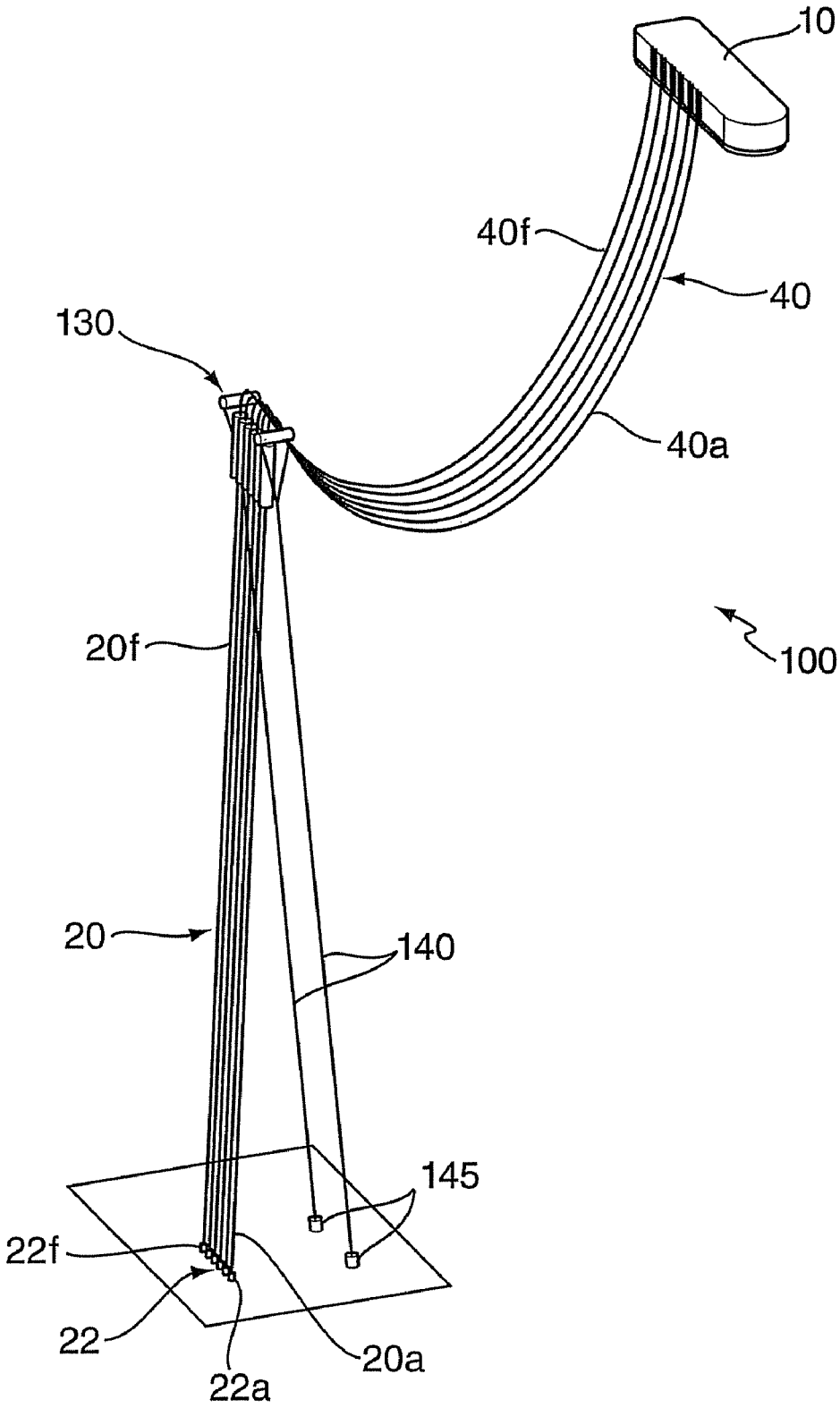
FIG. 2 shows a schematic depiction of an arrangement of a plurality of SLORs according to the present invention.
Figure 3:
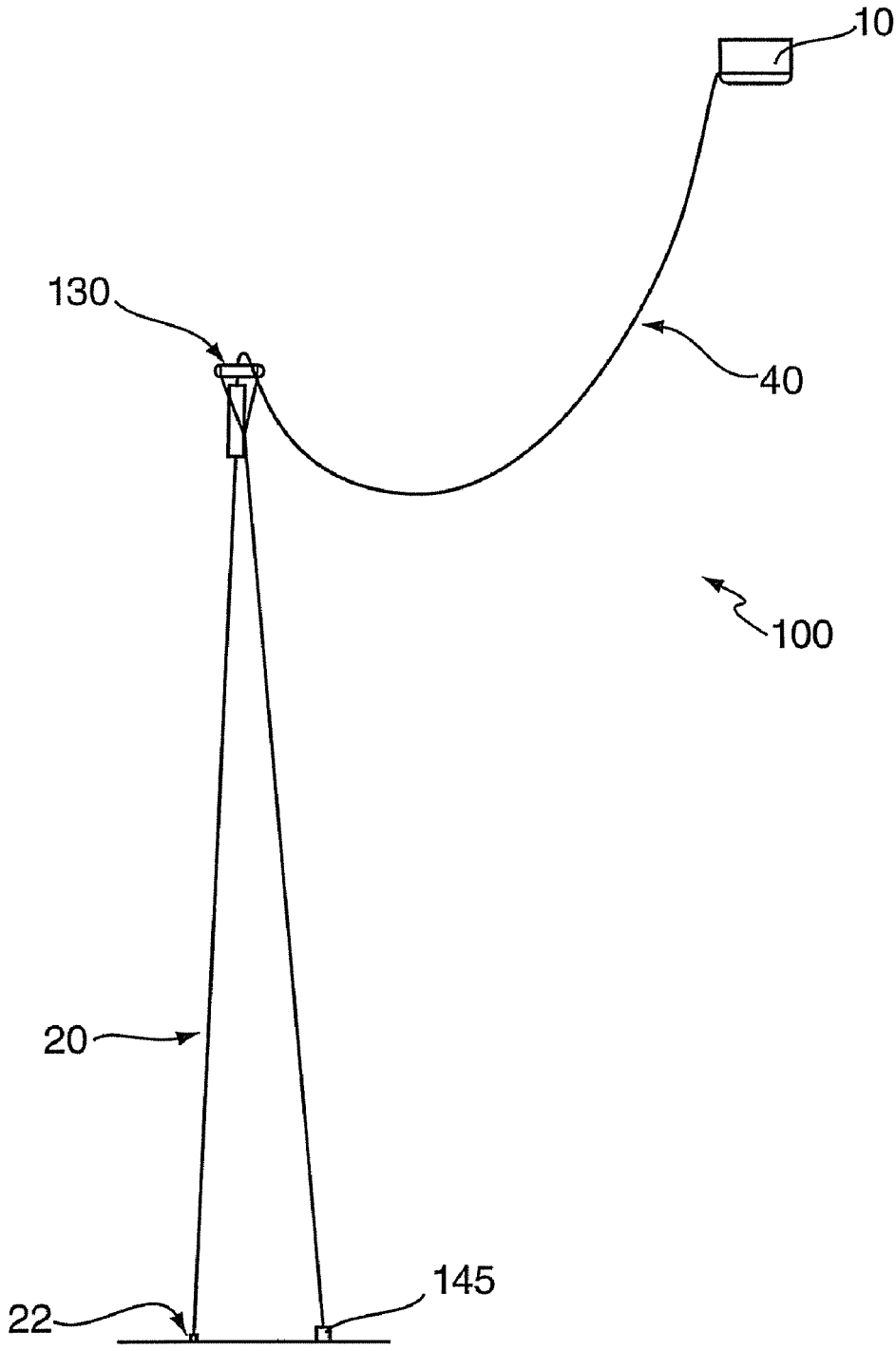
FIG. 3 shows a side view of the schematic depiction of an arrangement of a plurality of SLORs according to the present invention shown in FIG. 2.

FIG. 2 shows a schematic depiction of an arrangement 100 of a plurality of SLORs according to the present invention and FIG. 3 shows a side view of the schematic depiction of an arrangement of a plurality of SLORs according to the present invention shown in FIG. 2.

Figure 1:
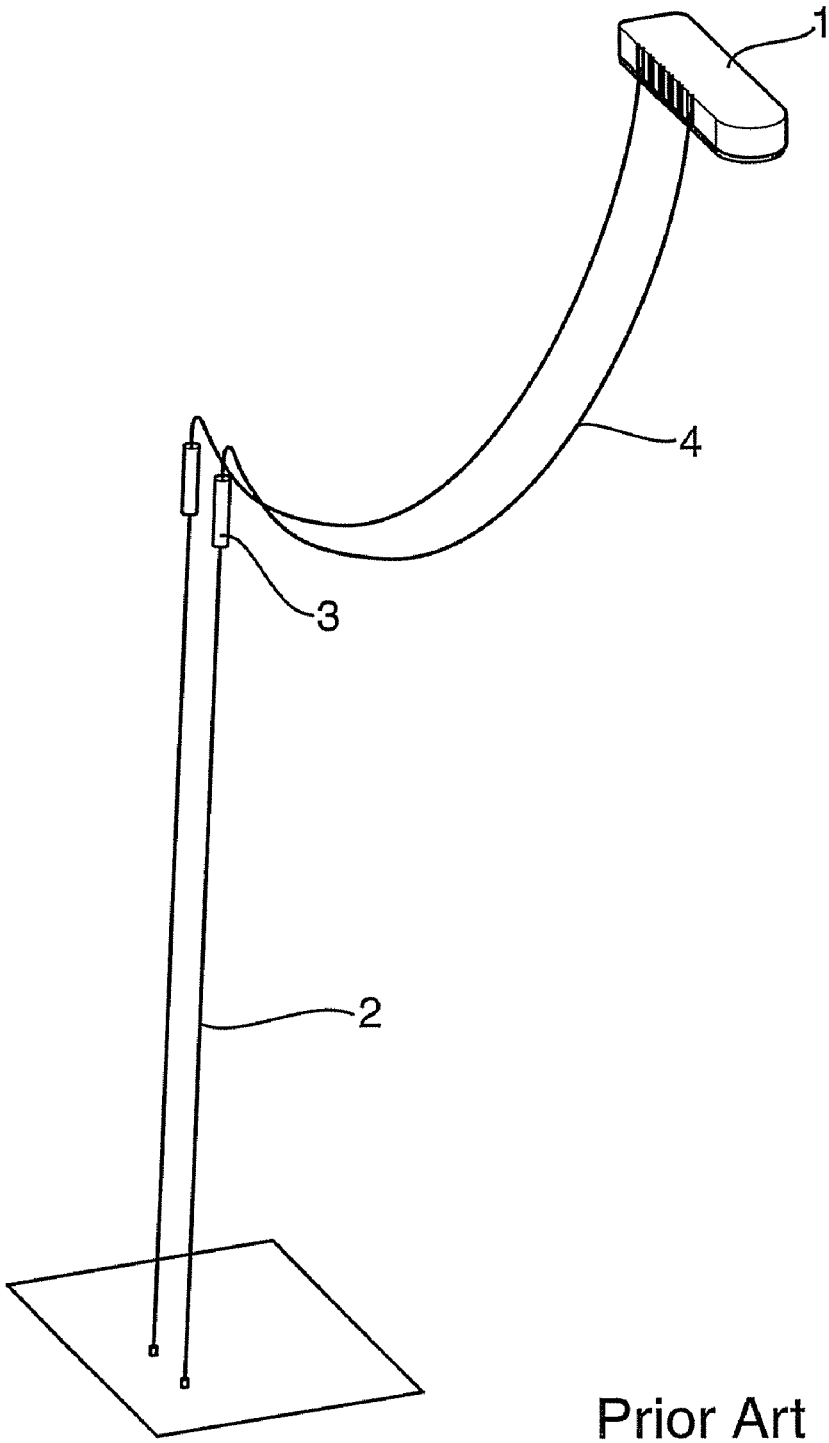
Prior Art FIG. 1
FIG. 1 shows a schematic depiction of a known arrangement in which two SLORs are connected to a surface vessel.

FIG. 2 shows that the arrangement 100 comprises a surface vessel 10, a plurality of vertical risers 20*a*, . . . , 20*f* (collectively indicated at 20), each of which are connected to the surface vessel 10 by a respective compliant, flexible pipe catenary section 40*a*, . . . , 40*f* (collectively indicated at 40). Each of the risers are secured to the seabed with a respective foundation 22*a*, . . . , 22*f* (collectively indicated at 22). In place of the single near-surface buoyancy module associated with each of the risers that is shown in FIG. 1, the risers are supported by a lightweight support frame 130 which is anchored to seabed foundations by two tethers 140, which are anchored to tether foundations 145. FIG. 3 shows that the riser foundations 22*a*, . . . , 22*f* are laterally offset from the tether foundations 145 so that there is no interference between the risers and the tethers.

In use, the support frame 130 is installed before the risers and preferably has sufficient buoyancy that it can free stand, independent of the risers (see below). The frame and its foundations are compact and lightweight so that they can be installed from a small installation vessel such as an anchor handling vessel. The vertical risers 20*a*, . . . , 20*f*, are then installed vertically in the usual manner on the out board side of the frame using a conventional installation vessel.

After connection of the riser 20*a*, . . . , 20*f* to its respective foundation 22*a*, . . . , 22*f* at the seabed an associated aircan 132*a*, . . . , 132*f* is fully aired-up so that the riser can free stand without support from the surface installation vessel. Subsequently the riser top assembly is laterally deflected to locate into a guide region that is formed within the support frame. Of the six guide regions, five 138*b*, . . . , 138*f* are visible in FIG. 4. This can be achieved using a tensioned wire from the installation vessel and assisted by a guidance structure on the frame and visually assisted using an ROV camera.

Figure 4:
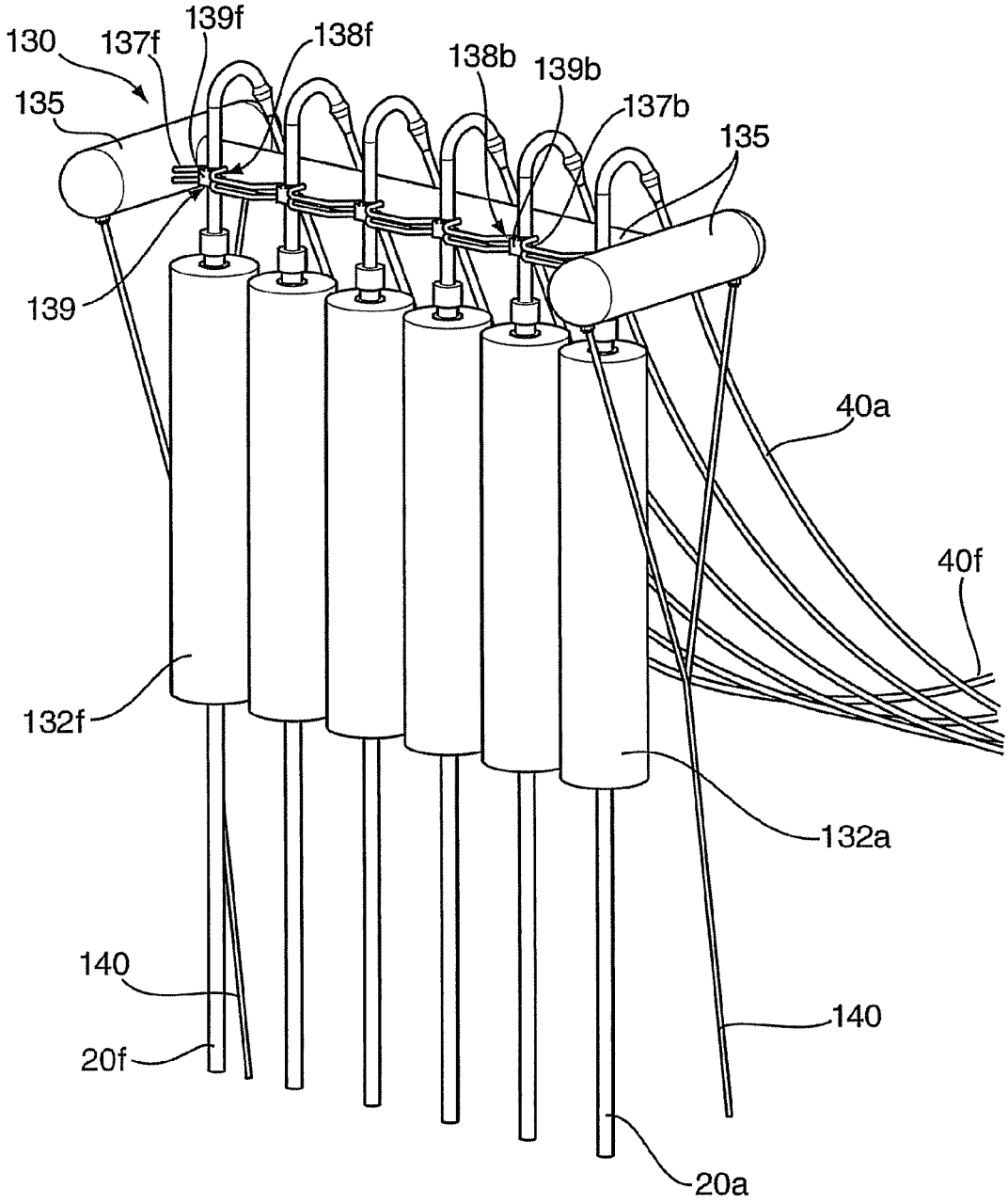
FIG. 4 shows a schematic depiction of the support frame shown in FIGS. 2 and 3.

FIG. 4 shows a schematic depiction of the support frame 130 once it has been populated with a plurality of risers 20. The support frame preferably comprises a number of buoyancy regions 135 that enable the frame to free stand, independent of the risers and/or a surface vessel. Each of the vertical risers, 20*a*, . . . , 20*f* is connected to an associated aircan 132*a*, . . . , 132*f* which is then received within one of the guide regions. After each vertical riser is secured within the support frame then the catenary 40*a*, . . . , 40*f* that links the top of the vertical riser to the production vessel is installed and the vertical riser can be commissioned for production service.

In order to facilitate the secure reception of the vertical risers each of the guide regions comprises a funnel. Of the six funnels, five 137*b*, . . . , 137*f* are visible in FIG. 4. A swing door clamp assembly is used to secure the riser top assembly in the support frame. Of the six swing door clamp assemblies, five 139*b*, . . . , 139*f* are visible in FIG. 4. The swing door clamp preferably comprises half shell Orkot™ type bearings that provide a low friction interface and allow relative movement to occur between the support frame and each individual vertical riser. This movement can occur due to temperature and pressure fluctuations and also due to lateral movement of the support frame due to current and vessel offsets. Once connected into the support frame all of the vertical risers are guided and constrained to displace sympathetically and without the fear of clashing since the support frame maintains a constant separation at the guiding elevation.

The support frame size can be designed to suit each particular development but typically facilities for up to 6 vertical risers are provided. In such a case the support frame has a size of approximately 36 m long by 6 m wide. It will be understood that the support frame may accommodate a greater or lesser number of vertical risers and that for support frames accommodating a different number of vertical risers then the support frame may well have a different size.

In all other respects the design of the vertical riser and catenary is that of a conventional SLOR. The design of the support frame and the securing means allows the vertical risers to be installed in any order and also accommodates all anticipated movements between the individual vertical risers and the support frame resulting from normal and extreme operating conditions.

An additional benefit of the system is that lateral motions at the top of the vertical riser assembly are reduced compared to a conventional SLOR due to the interaction of the tension in each of the individual lines and tethers producing a 'mooring' effect. This effect allows the support frame and aircans to be located closer to the water surface than would otherwise be possible with a conventional SLOR, thus simplifying access and installation of the jumper and reducing its required length. Furthermore, the proposed development does not lose the principle technical benefits and cost effectiveness of the SLOR concept: low sensitivity to vessel motions, high fatigue life, pre-installation capability, low vessel payload and pull-in loads and good thermal performance.

It will be understood that the preceding references to vertical risers are not intended to act as a geometrical limitation but as defining a functional difference over a catenary riser. In use, a vertical riser will define a vertical or substantially vertical path.

The invention claimed is:

1. A production system comprising:

a plurality of vertical risers;

a plurality of buoyancy modules, each of the plurality of buoyancy modules being connected to the upper end of a respective one of the plurality of vertical risers;

a moored and buoyant underwater support frame, the support frame having opposite first and second sides and comprising on said first side a plurality of guide means for receiving from said first side an upper end of each of the plurality of vertical risers, each of the plurality of risers being clamped within a respective guide means such that an interface between each of the risers and the respective guide means guides and constrains the movement of each riser and its associated buoyancy module so that each riser can move within the respective guide means independently of the other risers; and a plurality of production catenaries, each of the plurality of vertical risers being connected to a respective lower end of one of the plurality of production catenaries at the support frame; and the upper ends of each of the said production catenaries being connected to a surface vessel.

2. A production system according to claim 1, wherein the support frame is secured to the seabed via a plurality of tethers.

3. A production system according to claim 2, wherein the plurality of tethers are secured to a plurality of tether foundations.

4. A production system according to claim 3, wherein the plurality of vertical risers are secured to a plurality of riser foundations and the plurality of tether foundations are separated from the plurality of riser foundations.

5. A production system according to claim 1, wherein each guide means comprises on said first side a guide region for locating a corresponding one of said vertical risers when laterally deflected into said guide means.

6. A production system according to claim 5, wherein each of the plurality of guide regions comprises a guide funnel.

7. A production system according to claim 6, wherein each of the plurality of guide means comprises a clamping means to secure each of the plurality of vertical risers within a respective guide means.

8. A production system according to claim 1, wherein each of the plurality of guide means comprises a clamping means to secure each of the plurality of vertical risers within a respective guide means.

9. A production system according to claim 1, wherein each of the plurality of vertical risers is received within the respective guide means such that each of the vertical risers can move freely in a direction parallel to the axis of the riser.

10. A production system according to claim 1, wherein each of said production catenaries extends away from the second side of the support frame.

11. A method of connecting a plurality of production risers to a surface vessel, the method comprising the steps of:

a) mooring an underwater buoyant support frame in a position near to a plurality of vertical risers, the support frame having opposite first and second sides and comprising on said first side a plurality of guide means;

b) attaching a respective buoyancy module to an upper end of each of the plurality of vertical risers;

c) lifting each of the plurality of vertical risers;

d) inserting from said first side an upper end of each of the plurality of vertical risers into a respective one of said guide means and clamping each of the plurality of risers within a respective one of said guide means such that an interface between each of the risers and the respective guide means guides and constrains the movement of each riser and its associated buoyancy module so that each riser can move within the respective guide means independently of the other risers;

e) connecting a lower end of a respective production catenary to each of the plurality of vertical risers at the support frame; and f) connecting an upper end of each of said production catenaries to the surface vessel.

12. A method according to claim 11, wherein the support frame is tethered in the position near to the plurality of vertical risers.

13. A method according to claim 11, wherein each of said production catenaries extends away from the second side of the support frame.

* * * * *